United States Patent [19]

Yokeley

[11] Patent Number: 4,833,747

[45] Date of Patent: May 30, 1989

[54] DYEING METHOD

[76] Inventor: Chris C. Yokeley, P. O. Box 705, Thomasville, N.C. 27360

[21] Appl. No.: 124,481

[22] Filed: Nov. 23, 1987

[51] Int. Cl.[4] ..... D06B 1/02; D06B 11/00

[52] U.S. Cl. ..... 8/149; 8/150; 8/158; 68/205 R

[58] Field of Search ..... 8/149, 158, 102, 150, 8/483; 68/58, 205 R

[56] References Cited

U.S. PATENT DOCUMENTS

| | | | |
|---|---|---|---|
| 1,456,344 | 5/1923 | Van Ness | 8/149 |
| 1,871,486 | 8/1932 | Whitehead | 8/149 |
| 2,678,868 | 5/1954 | Drum et al. | 8/150 |
| 3,120,422 | 2/1964 | Weir | 8/149 X |
| 3,955,227 | 5/1976 | Siegfried | 8/150 |
| 4,009,001 | 2/1977 | Reid, Jr. et al. | 8/454 |
| 4,111,645 | 9/1978 | Zurbuchen et al. | 8/150 X |

FOREIGN PATENT DOCUMENTS

| | | | |
|---|---|---|---|
| 1958649 | 5/1971 | Fed. Rep. of Germany | 8/483 |
| 780496 | 8/1957 | United Kingdom | 8/150 |

OTHER PUBLICATIONS

Bulletin No. 18 of DuPont, "Multicoloration of Nylon Carpet by the 'TAK' Dyeing Technique", published Nov. 11, 1971.

*Hosiery and Underwear,* Body Fashions/Intimate Apparel, Section 2, Jun. 1988.

*Primary Examiner*—Philip R. Coe

[57] ABSTRACT

A dyeing apparatus and method is presented whereby garments such as socks and other articles can be dyed to provide a mottled, random coloration thereon. The apparatus consists of a rotating container into which colorants or discolorants are dripped as the articles therein are tumbled. Garments can be colored with one or more substances to provide a wide variety in styles and patterns.

11 Claims, 2 Drawing Sheets

DYEING METHOD

BACKGROUND OF THE INVENTION

1. Field of the Invention

The present invention relates to a dyeing apparatus and method for coloring articles such as garments or other textile products and particularly relates to batch dyeing processes.

2. Description Of The Prior Art And Objectives Of The Invention

Various techniques have been practiced in the textile industry for coloring or discoloring yarns, fabrics and garments including many continuous and batch dyeing techniques. In recent years, the fashion industry has promoted "worn" or faded styles whereby denim products are bleached and are "stone washed" to provide the fabric with an "aged or used" appearance. Style-conscious consumers are always looking for unique-appearing garments and as the current fashion trends provide a myriad of garment selections, the present invention was conceived and one of the objectives of the invention is to provide wearing apparel having a new, decorative mottled appearance.

It is another objective of the present invention to provide dyeing apparatus which will color garments such as socks or the like in a random, mottled manner in a fast, efficient process.

It is yet another objective of the present invention to provide dyeing apparatus which includes a rotatable container having a conduit attached thereto for supplying colorants or discolorants in an intermittent, periodic fashion.

It is also an objective of the present invention to provide products formed by the process with a unique, distinctive appearance which would be readily acceptable by the fashion-conscious consumers.

Other objectives and advantages of the present invention will become apparent to those skilled in the art as a more detailed description is presented below.

SUMMARY OF THE INVENTION

The aforesaid and other objectives of the invention are realized by providing dyeing apparatus having a rotatable container with baffles therein which will tumble the contents such as textile articles during rotation. A fluid conduit extends into the rotatable container which is provided with one or more outlets or apertures. A colorant source is connected to the conduit whereby, upon rotation of the container, liquid dye or colorants can be directed through the conduit and intermittently enter the container during rotation thereof to impinge the articles contained therein. The articles thus colored have an irregular dye pattern thereon and one or more colors can be introduced into the rotatable container either by adding additional conduits thereto or by allowing different colorants or discolorants to sequentially pass through a single conduit.

DESCRIPTION OF THE PREFERRED EMBODIMENTS

The preferred form of the apparatus of the invention consists of a rotatable container which is driven by an electric motor and heated by a gas burner. Attached to the rotatable container or rotation therearound is a fluid conduit whereby a desired substance such as a dye, bleach or other colorants or discolorants can be intermittently delivered into the container as it rotates. Attached to the fluid conduit is a dye source such as a dye tank and a pump is provided for directing the colorant fluids along the conduit and into the rotatable container.

The preferred method of the invention consists of placing textile articles into the container and rotating the container around its horizontal axis. During rotation, a heated liquid colorant is delivered into a fixed conduit and openings therealong allow the colorant to periodically drip onto the garments during rotation and tumbling. After the dyeing process has sufficiently proceeded, the colorant supply is terminated and the articles are removed therefrom and conventional finishing techniques are applied.

The preferred form of the product of the process consists of wearing apparel which can be identified by its mottled, irregularly colored appearance.

DETAILED DESCRIPTION OF THE DRAWINGS AND OPERATION OF THE INVENTION

Figure 1:
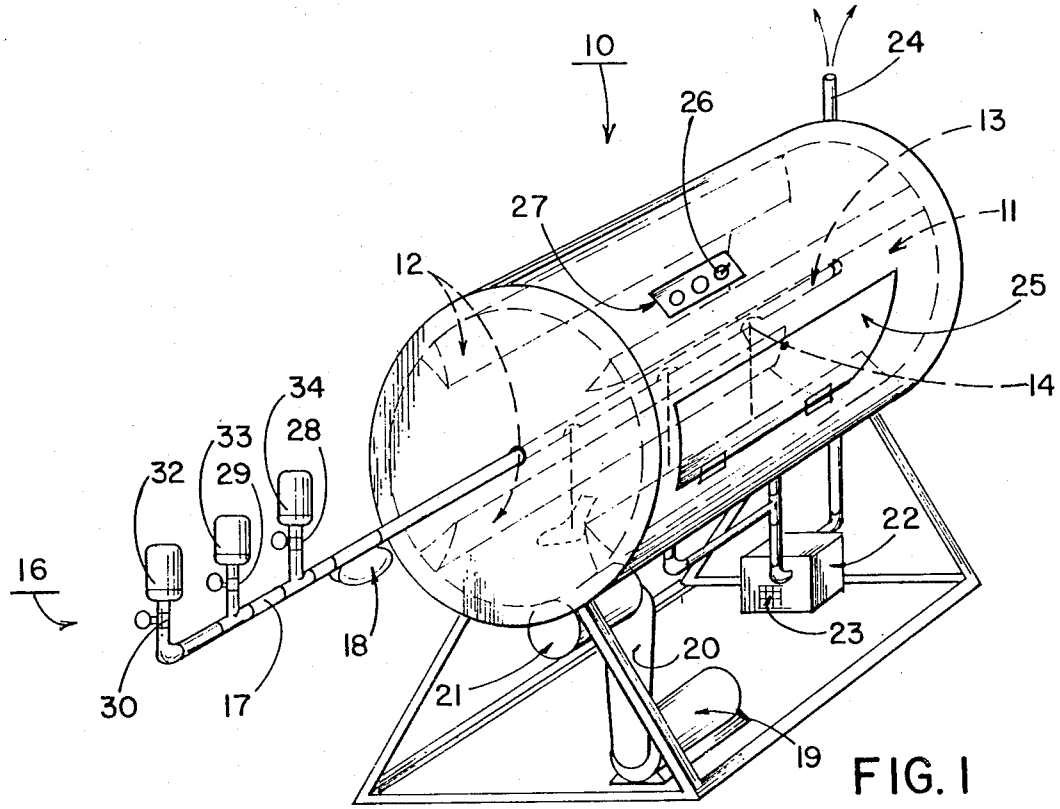
FIG. 1 demonstrates dyeing apparatus of the present invention.

Turning now to the drawings, dyeing apparatus 10 as shown in FIG. 1 includes a rotatable drum or container 11 having a series of baffles 12 which tumble articles placed therein to provide a thorough mixing and blending action. Fluid conduit 13 consists of a pipe or tube with a series of apertures 14 therealong. Apertures 14 allow for the intermittent delivery such as by dripping of a heated (110° F.) colorant such as a cold reactive dye solution as, for example, a Procion TM dye as manufactured by ICI Americas, or a discolorant such as a bleach into rotatable container 11 onto socks 15 which may be cotton plaited nylon (50/50) as conventionally made although 100% natural or synthetic yarns or other various blends thereof are anticipated to be processed as herein described. Thus, as container 11 is rotated articles such as socks 15 are intermittently and randomly impinged with the desired coloring substance. As would be understood, various types of articles can be processed within apparatus 10 whether they be piece goods, garments, yarns or other products.

Figure 4:
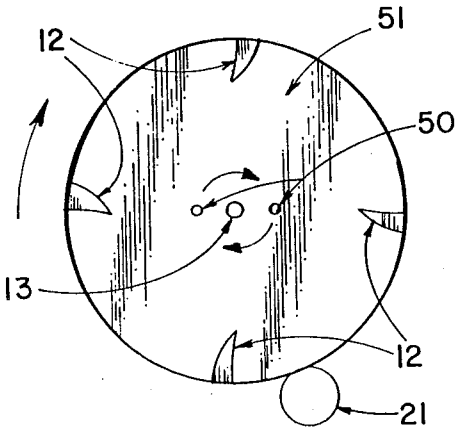
FIG. 4 shows a partial inside view of another embodiment of the rotatable container.
Figure 2:
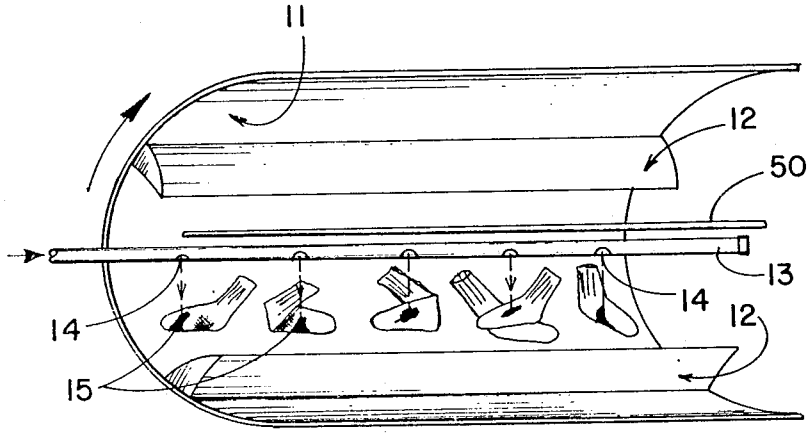
FIG. 2 illustrates an enlarged view of a section of the inside of the container of the dyeing apparatus of FIG. 1 with socks being processed therein.

As further seen in FIG. 1, conduit 13 is attached to container 11 but remains stationary and container 11 rotates therearound. In FIG. 1 only one (1) conduit is shown although a plurality of conduits may be employed as required. In certain circumstances articles within container 11 may be tossed upon conduit 13 and to prevent or remedy this occurrence, sweep arms 50 as seen in FIG. 4 are provided. Sweep arms 50 parallel conduit 13 and rotate therearound as they are affixed to the rotatable end walls 51 of container 11. During rotation, arms 50 brush off any articles that may have fallen on conduit 13 during rotation or tumbling.

Dye source 16 as shown in FIG. 1 consists of dye tanks 32, 33 and 34 which feed into manifold 17 which is joined to pump 18. Pump 18 forces liquid along conduit 13 from one or more of tanks 32, 33 or 34 as required. Pump 18 consists of an adjustable metering pump of conventional design and sized to adequately supply the colorant requirements. Tanks 32, 33 and 34 may have jacket or other heaters as needed. Conduit 13 can be gravity fed or may be pump fed as shown in FIG. 1 depending on the particular requirements of the user. Apparatus 10 includes electric motor 19 and motor transmission 20 which consists of a gear reduction mechanism and drive means 21 which comprises a roller for turning container 11 and which is connected to transmission 20. Gas burner 22 and centrifugal fan 23 supply heat to container 11. Exhaust stack 24 allows the combustion components to be expelled outside into the atmosphere. Other types of heating systems such as heat exchangers employing steam can be used as practical and to obtain the heat ranges needed. For example, on 100% nylon articles certain acid dyes may require a temperature of approximately 200° F. to properly fix the dye.

The method of operation of apparatus 10 comprises opening door 25 for the loading of socks 15 or other articles. Once inside container 11 has been sufficiently loaded, motor 19 is activated by switch 26 on control panel 27 and the rotation of container 11 begins. The articles therein are tumbled and valve 28 can then be opened and pump 18 turned on to force the desired dyeing substance which may be a liquid dye at a slow rate through conduit 13. Conduit 13 then allows the liquid from dye tank 34 to slowly drip onto the articles contained therein to provide a mottled, randomly colored appearance. Once sufficient dye has been supplied, valve 28 can be turned off and valve 29 opened as tank 33 may contain a different colorant or discolorant such as a bleach and in sequential fashion thereafter, valve 29 can be closed and valve 30 opened and another colorant such as a dye or bleach from tank 32 is supplied. Once articles 15 are sufficiently impinged with the colorant, pump 18 is turned off and container 11 can then be heated by burner 22 or motor 19 can be turned off and articles 15 removed and conventional finishing processes employed. As would be understood, apparatus 10 and the methods as shown herein are simplified versions and automatic or microprocessor controls can be utilized in place of manual controls for greater production requirements and where automation and high speeds are justified to reduce cost and overhead expenses.

Figure 3:
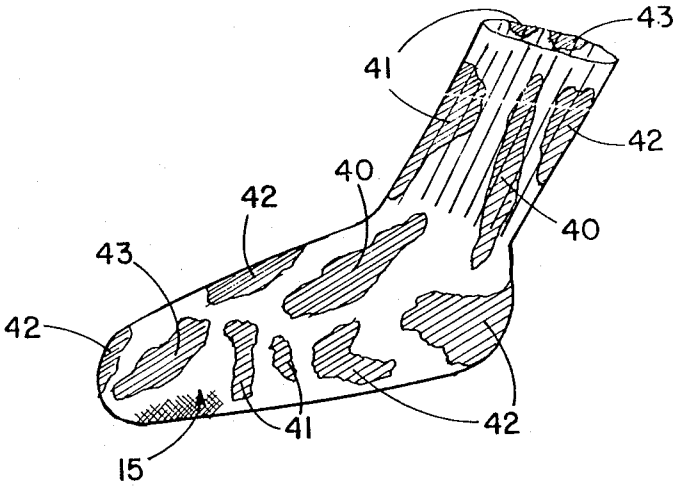
FIG. 3 depicts a sock which has undergone the intermittent dyeing process.

Sock 15 as shown in FIG. 3 demonstrates only one product formed by the process of the invention wherein socks are first knitted by conventional means with a white bleached cotton yarn plaited over a whitened nylon yarn and therefore after dyeing form a garment having a substantially white background 40. By dripping two (2) colors of dye, red and blue, sock 15 has areas 41 which are substantially red in appearance, areas 42 substantially blue and areas 43 substantially purple since areas 43 demonstrate the mixing of red and blue dyes thereon. Various rates of colorant delivery, rotational speed of container 11 and other variables contribute to the ultimate appearance of a particular article colored in this manner.

Various changes and modifications can be made to the invention by those skilled in the art without departing from its intended scope and the illustrations and examples provided herein are for explanatory purposes and are not intended to limit the appended claims.

I claim:

1. A process for coloring articles comprising the steps of: placing the articles in a rotatable apparatus, rotating the apparatus and intermittently delivering a desired substance into the rotatable apparatus to randomly color the articles.

2. The process of claim 1 and including the step of removing the articles from the rotatable apparatus.

3. The process of claim 1 and including the step of heating the articles.

4. The process of claim 1 wherein the step of delivering a desired substance in the rotatable apparatus comprises intermittently delivering a dye solution into the rotatable apparatus.

5. The process of claim 1 wherein the step of delivering a desired substance in the rotatable apparatus comprises intermittently delivering a bleach solution into the rotatable apparatus.

6. The process of claim 1 wherein delivering a desired substance includes the step of dripping a desired substance into the rotatable apparatus.

7. The process of claim 1 and including the step of tumbling the articles within the rotatable apparatus.

8. The process of claim 1 wherein delivering a desired substance into the rotatable apparatus comprises delivering a plurality of substances into the apparatus to randomly color the articles.

9. A process for an dyeing article comprising the steps of:

(a) placing an article to be dyed into a rotatable apparatus;

(b) rotating the apparatus to tumble the article therein;

(c) intermittently delivering a dye solution onto the article as it tumbles to randomly dye the article.

10. The process of claim 9 wherein the article comprises a sock.

11. The process of claim 9 wherein the step of intermittently delivering a dye solution comprises intermittently delivering a plurality of dye solutions into the rotatable apparatus.

* * * * *